US005871290A

United States Patent [19]

Fujimoto et al.

[11] Patent Number: 5,871,290

[45] Date of Patent: Feb. 16, 1999

[54] STAMPING DEVICE WITH ROLLERS MOUNTED FOR PIVOTAL MOVEMENT

[75] Inventors: Akimasa Fujimoto; Hidekimi Yamamoto; Michio Ueda, all of Tokushima, Japan

[73] Assignee: Shikoku Kakoki Co., Ltd., Tokushima, Japan

[21] Appl. No.: 942,553

[22] Filed: Oct. 1, 1997

[30] Foreign Application Priority Data

Oct. 2, 1996 [JP] Japan ..... 8/261757

[51] Int. Cl.[6] ..... B41J 1/54

[52] U.S. Cl. ..... 400/151.1; 101/328; 101/376; 400/171

[58] Field of Search ..... 400/151, 151.1, 400/149, 171; 101/35, 36, 37, 375, 376, 328

[56] References Cited

U.S. PATENT DOCUMENTS

| | | | |
|---|---|---|---|
| 1,443,164 | 1/1923 | Bracken | 101/5 |
| 2,551,633 | 5/1951 | Preis | 101/6 |
| 3,205,305 | 9/1965 | Clark et al. | 400/151.1 |
| 3,306,197 | 2/1967 | Jensen et al. | 101/328 |
| 3,788,028 | 1/1974 | Folkesson et al. | 53/51 |
| 3,811,546 | 5/1974 | Suzuki et al. | 400/151 |
| 4,095,686 | 6/1978 | Okabe | 400/151.1 |
| 4,178,847 | 12/1979 | Erhardt | 101/35 |
| 4,239,002 | 12/1980 | Rosenstein | 101/376 |
| 5,012,735 | 5/1991 | Fischer et al. | 101/177 |

FOREIGN PATENT DOCUMENTS

| | | |
|---|---|---|
| 2 537 995 A3 | 6/1984 | France . |
| 3 313 219 A1 | 10/1984 | Germany . |
| SHO 57-44525 | 9/1982 | Japan . |
| SHO 61-93010 | 5/1986 | Japan . |

*Primary Examiner*—Edgar Burr
*Assistant Examiner*—Leslie Grohusky
*Attorney, Agent, or Firm*—Armstrong, Westerman Hattori, McLeland & Naughton

[57] ABSTRACT

A stamping device includes two stamp rollers and a support member having the two stamp rollers mounted thereon and arranged on a circumference having a center at a center of pivotal movement. The stamp rollers are spaced apart by a predetermined angle about the center, a rotary actuator for pivotally moving the support member so that one of the stamp rollers in a stamping position and the other stamp rollers in a standby position are alternately shiftable to the other position, and drive means for rotating the stamp roller in the stamping position.

5 Claims, 6 Drawing Sheets

STAMPING DEVICE WITH ROLLERS MOUNTED FOR PIVOTAL MOVEMENT

BACKGROUND OF THE INVENTION

The present invention relates to a stamping device for use in packaging machines for producing closed content-filled rectangular parallelepipedal containers from a web of packaging material, the stamping device being adapted to impress the web with data such as the preservable period, quality retaining period, time, lot number and production supervision mark.

JP-B-44525/1982, FIG. 3 discloses a conventional stamping device for use in packaging machines for producing closed content-filled rectangular parallelepipedal containers from a web of packaging material. The disclosed stamping device comprises one stamp roller having an interchangeable stamp.

When the data to be impressed is to be altered, the conventional stamping device requires the procedure of suspending the operation of the packaging machine and replacing the stamp by another stamp. The device therefore has the problem the alteration of the data to be impressed diminishes the operating time of the packaging machine.

SUMMARY OF THE INVENTION

An object of the present invention is to provide a stamping device wherein the data to be impressed can be altered without suspending the operation of the packaging machine.

Another object of the invention is to provide a stamping device wherein the data to be impressed can be altered without suspending the operation of the packaging machine and which is nevertheless compact.

The present invention provides as a first feature thereof a stamping device comprising a plurality of stamp rollers, a support member having the stamp rollers mounted thereon and arranged on a circumference having a center at a center of rotation or pivotal movement, the stamp rollers being spaced apart by a predetermined angle about the center, drive means for rotating or pivotally moving the support member so that one of the stamp rollers in a stamping position and another one of the stamp rollers in a standby position are successively shiftable from one of the positions to the other position, and drive means for rotating the stamp roller in the stamping position.

The drive means to be used for rotating the support member is, for example, a stepping motor (pulse motor) or servo motor. The drive means to be used for pivotally moving the support member comprises, for example, a hydraulic cylinder for driving an arm of the support member which arm is fixed to a pivot for the member, or a rotary actuator connected directly to the pivot.

With the stamping device of the invention described, the stamp roller in the standby position is replaced in advance by a stamp roller marked with the data to be impressed next, and the support member is rotated or pivotally moved when there arise a need to alter the data to be impressed. Thus, the data can be altered without necessitating the suspension of operation of the packaging machine and therefore without reducing the operating time of the machine.

The present invention further provides as a second feature thereof a stamping device comprising two stamp rollers, a support member having the two stamp rollers mounted thereon and arranged on a circumference having a center at a center of pivotal movement, the stamp rollers being spaced apart by a predetermined angle about the center, drive means for pivotally moving the support member so that one of the stamp rollers in a stamping position and the other stamp rollers in a standby position are alternately shiftable to the other position, and drive means for rotating the stamp roller in the stamping position.

The predetermined angle is smaller than 180 degrees, and is preferably 45 degrees to 100 degrees.

With the stamping device embodying the second feature of the invention, the stamp roller in the standby position is replaced in advance by a stamp roller marked with the data to be impressed next, and the support member is rotated or pivotally moved when there arise a need to alter the data to be impressed. Thus, the data can be altered without necessitating the suspension of operation of the packaging machine and therefore without reducing the operating time of the machine. If the predetermined angle is, for example, 90 degrees, the space required for pivotally moving the support member carrying the two stamp rollers corresponds to 180 degrees in terms of an angle, and can therefore be one half of the space required when the support member having the two stamp rollers is rotated through 360 degrees, consequently making the stamping device compact. It appears likely that when the joint of two webs passes through the clearance between the stamp roller and the impression roller, the joint portion, which has twice the thickness of the web, will burden the pivot or will be broken when failing to pass through the clearance, whereas the support member, which is pivotally moveable by the drive means, serves as a spring in being shiftable toward the direction of pivotal movement to increase the clearance when passing the joint therethrough, restoring the clearance to the usual size upon the passage of the joint.

With the stamping device embodying the first or second feature of the invention, the drive means for rotating the stamp roller preferably comprises a motor having an output shaft in alignment with the axis of the stamp roller in the stamping position, a drive projection provided eccentrically on the motor output shaft, and a driven projection provided on the stamping roller so as to be pushed by the drive projection during revolution. When the motor is rotated after the replacement of the stamp roller by pivotally moving the support member, the drive projection pushes the driven projection, rotating the stamp roller placed in the stamping position by the replacement. As a result, the stamping operation can be continued as it is without following any special procedure despite the roller replacement.

A plurality of stamps are attached to the outer peripheral surface of each of the stamping rollers and spaced apart by a predetermined angle, and the stamp roller in the stamping position is rotated by the drive means through the predetermined angle at a time. Each of the stamps comprises stamp pieces of numerals, English characters, etc. in combination. As to the number of stamps, a plurality of stamps can be arranged usually in parallel as spaced apart at a predetermined interval in accordance with the length of the web corresponding to one container or with the speed of travel of the web. The data can then be impressed on a plurality of portions of the web during one turn of rotation of the stamp roller. The device is then usable also for the web to be transported at a high speed. For example, when the step subsequent to the stamping step is to be performed with use of one of a plurality of devices, the device to be used can be identified by the impression since different items of data can be impressed with different stamps.

DESCRIPTION OF THE PREFERRED EMBODIMENT

Figure 1:
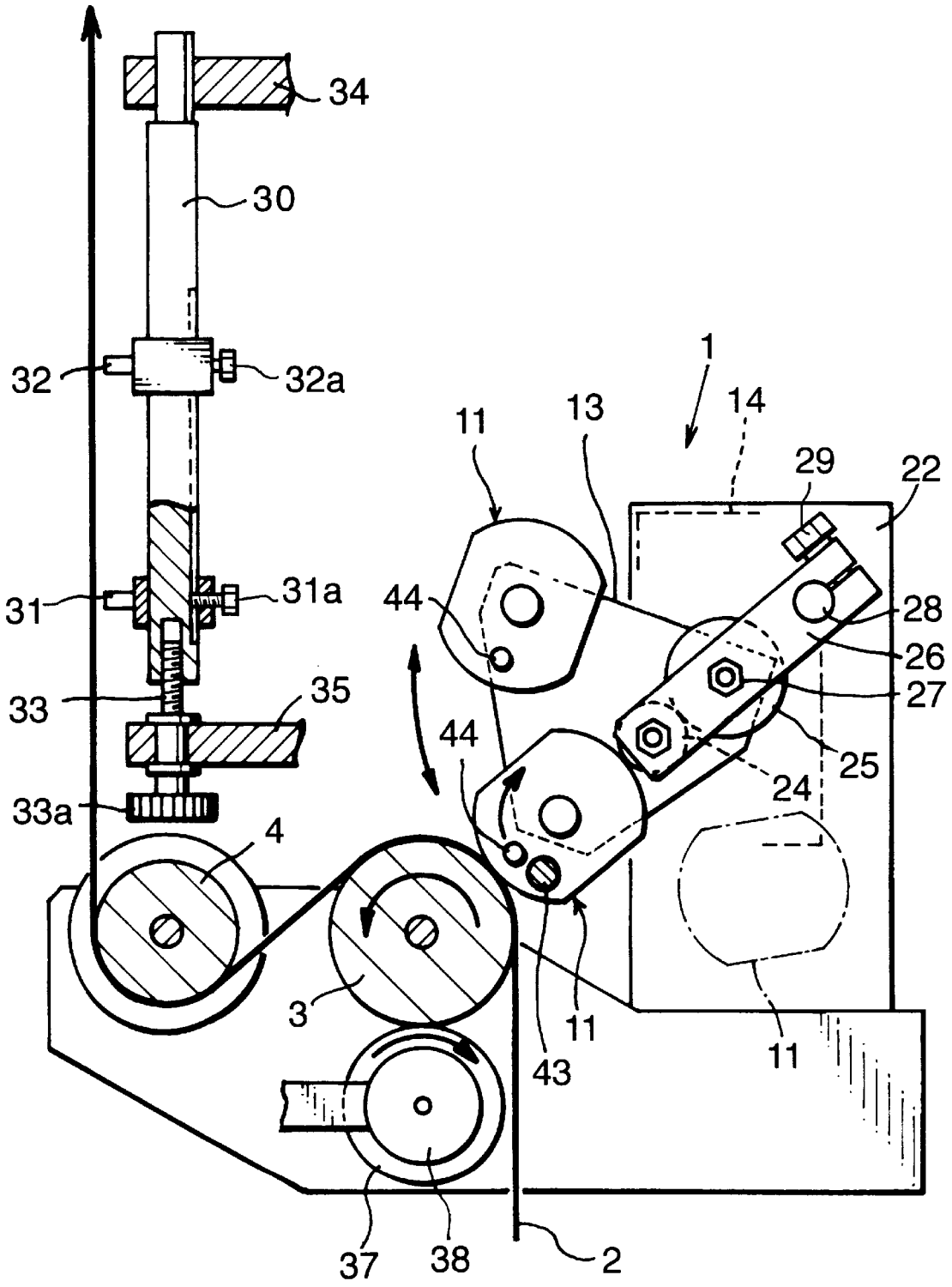
FIG. 1 is a front view showing a stamping device embodying the invention.

An embodiment of the invention will be described below with reference to the drawings. In the following description, the terms "Upper" and "lower" refer respectively to the upper and lower sides of FIG. 1.

FIGS. 1 to 8 show the embodiment of the invention, i.e., a stamping device 1. The stamping device 1 is installed in a packaging machine for preparing from a web 2 of packaging material closed rectangular parallelepipedal containers filled with contents. The device 1 is adapted to impress stamping spaces on the web 2 with the preservable period, quality retaining period, time, lot number, production supervision mark, etc. The stamping spaces are provided at an interval corresponding to the length of one container. The web 2 is fed to the stamping device 1 from below and continuously transported upward along an impression roller 3 serving as an impression cylinder and a guide roller 4. The speed of travel of the web 2 is not constant but varies by being influenced by the subsequent process including a container closing step.

The stamping device 1 comprises two stamp rollers 11, a support member 13 carrying the two stamp rollers 11 on a circumference centered about a pivot supporting the member 13 thereon, a rotary actuator 14 for pivotally moving the support member 13 so as to alternately position one of the rollers 11 at a stamping position and the other roller 11 at a standby position, and drive means 15 for rotating the stamp roller 11 at the stamping position.

Each stamp roller 11 is formed in its outer peripheral surface with two stamp mounts 12 circular arc in cross section and spaced apart by 180 degrees about the center of the roller as will be described later. With stamps 16 attached to the stamp mounts 12, the stamp roller 11 is adapted to mark the impression on the web for two containers during one turn of rotation.

Figure 2:
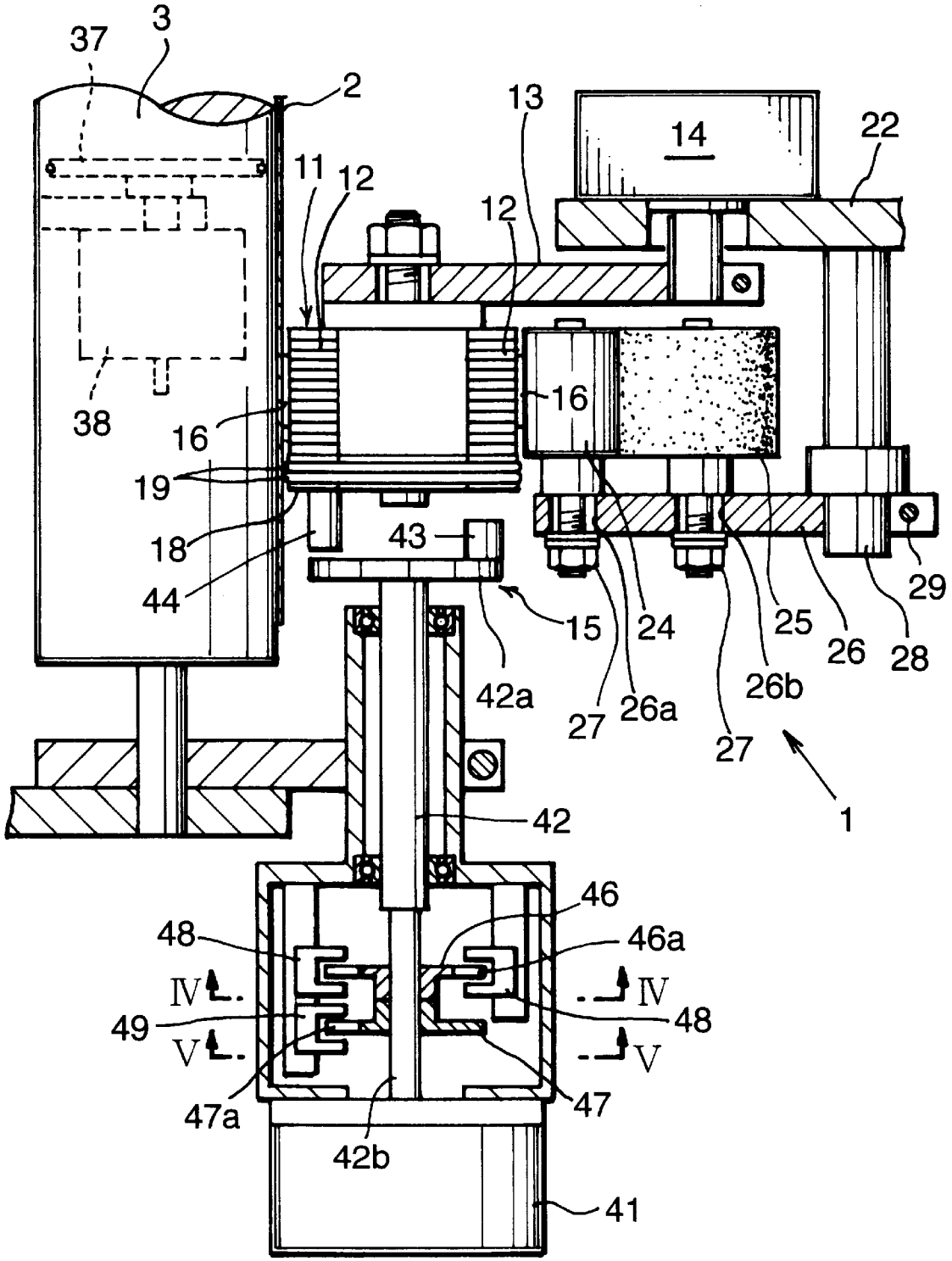
FIG. 2 is a plan view of the same.
Figure 3:
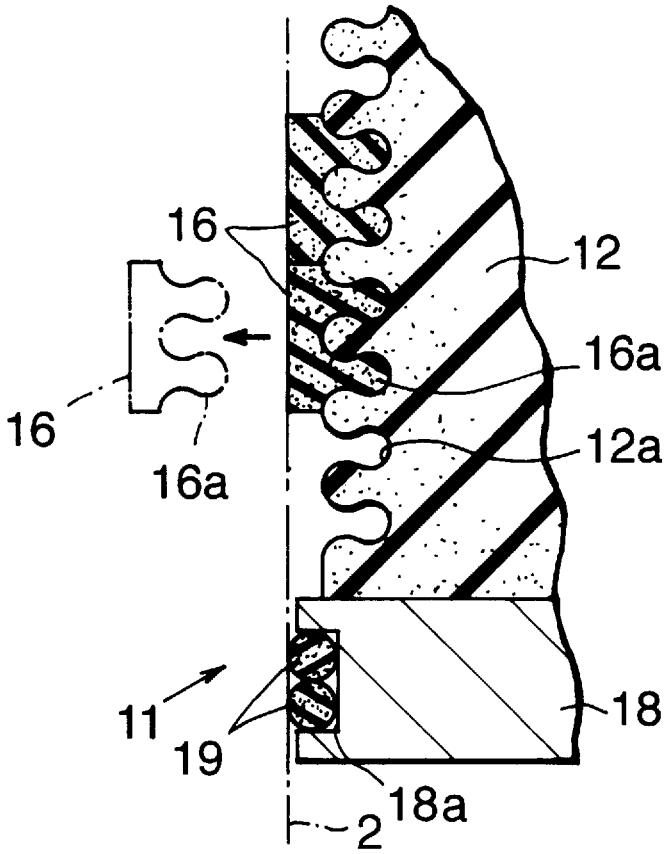
FIG. 3 is an enlarged fragmentary view of a stamp roller.

With reference to FIGS. 2 and 3, the stamp mounts 12 are made of elastic bodies coaxial with the stamp roller 11, and are formed with a multiplicity of fitting cavities 12*a* at an interval. Each stamp 16 is formed with fitting projections 16*a* fittable in some of the cavities 12*a* of the stamp mount 12. Two O-rings 18 adjacent the respective stamp mounts 12 and radially larger than the mounts 12 are provided coaxially with the stamp roller 11. Each O-ring mount 18 is formed with a groove 18*a* extending circumferentially of the roller 11. O rings 19 are reeved around the two O-ring mounts 18. The O rings 19 project outward slightly beyond the mounts 18, and the outer peripheries of the O rings 19 as fitted to the mounts 18 in their grooves 18*a* are at the same distance as the surfaces of the stamps 16 from the axis of the stamp roller 11.

The support member 13 is a vertical plate generally in the form of a regular triangle. The output shaft of the rotary actuator 14 is attached to one of the three corners of the support member 13. The stamp rollers 11 are mounted on the remaining two corners of the member 13, each with its outer peripheral surface projecting beyond the member 13.

The rotary actuator 14 is mounted on a vertical actuator mount plate 22 for pivotally moving the support member 13 through about 60 degrees. When the support member 13 is moved counterclockwise from the solid-line position shown in FIG. 1, the stamp roller 11 in the stamping position moves to the standby position indicated in a broken line in the same drawing. The range of movement of the support member 13 and two stamp rollers 11 is limited to a sectorial area having a central angle of 120 degrees about the shaft of the rotary actuator 14.

An ink is supplied to the stamp roller 11 by an ink transfer roller 24 which is so disposed as to come into contact with the set of stamps 16 at one side of the roller 11 opposite to the set of stamps 16 in use for impression. The ink is supplied to the transfer roller 24 by an ink-impregnated roller 25. These rollers 24, 25 are attached to a mount plate 26 by bolt-end-nut fasteners 27 inserted through respective slots 26*a*, 26*b* formed in the plate 26, the position of the rollers being finely adjustable longitudinally of the ink roller mount plate 26. The mount plate 26 is removably fastened by a bolt 29 to the outer end of a horizontal support 28 extending from the actuator mount plate 22.

Extending above the guide roller 4 is a sensor mount bar 30 along the path of travel of the web 2. Two photoelectric sensors 31, 32 spaced apart by a predetermined distance are attached to the mount bar 30 by respective bolts 31*a*, 32*a* and adjustable in position vertically. The lower sensor 31 is used for giving a stamping command, and the upper sensor 32 for recognizing the stamping position. A position adjusting screw 33 provided with a handle 33*a* is screwed in the lower end of the mount bar 30. The sensor mount bar 30 is slidably supported at its upper end by an upper fixed plate 34. The screw 33 is rotatably supported by a lower fixed plate 35 while being prevented from sliding. The position of the bar 30 is finely adjustable upward or downward by turning the handle 33*a* of the screw 33.

Provided in contact with the impression roller 3 is a web speed detecting roller 37 equipped with an encoder 39. The speed of travel of the web 2 can be determined from the rotation angular velocity of the detecting roller 37 by the encoder 39.

The stamps 16 and the O rings 19 on the stamp roller 11 are so adjusted as to press the web 2 against the impression roller 2 when in the stamping position. While the web 2 is being pressed against the impression roller 3 by the O rings 19, the stamps 16 are moved at the same speed as the web 2 by the force of friction acting between the web 2 and the rings 19 to mark the impression. The stamp roller 11 stops upon the O rings 19 moving out of contact with the web 2.

The drive means 15 serves to rotate the stamp roller 11 at rest to the position where the roller 11 is rotatable by the frictional force between the web 2 and the O rings 19. As shown in FIG. 2, the drive means comprises a pulse motor 41 having an output shaft 42 in alignment with the axis of the stamp roller 11 at the stamping position, a drive pin 43 provided eccentrically on a disk 42*a* mounted on the outer end of the output shaft 42 coaxially therewith, and a driven pin 44 provided eccentrically on the stamp roller 11. The distance from the axis of the pulse motor output shaft 42 to the drive pin 43 is equal to the distance from the axis of the stamp roller 11 to the driven pin 44. When the pulse motor 41 is rotated while the stamp roller 11 is at a halt, the drive pin 43 comes into contact with the driven pin 44, thereafter rotating the stamp roller 11 together with the output shaft 42 of the pulse motor 41 and permitting the stamp roller 11 to be rotated with the frictional force between the web 2 and the O rings 19 as stated above.

The pulse motor 41 rotates through 180 degrees every time a stamping command signal is output. The speed of rotation of the pulse motor 41, which is variable, is set at the same value as the speed of travel of the web 2 that is determined by calculation means from the signal from the encoder 39. The period of time after the production of the stamping command signal until the start of rotation is determined also based on the speed of travel of the web 2 determined by the calculation means from the signal from the encoder 38.

The output shaft 42 of the pulse motor 41 has two rotary disks 46, 47 attached to a base end portion 42*b* thereof coaxially therewith and formed with slits 46*a*, 47*a*, respectively. The rotary disk 46 remote from the base end of the output shaft 42 serves to determine the stop position of the pulse motor 41, and the rotary disk 47 close to the base end is used for recognizing the position of the stamp roller 11, i.e., the angular position of the roller 11 as oriented toward the stamping direction.

Figure 4:
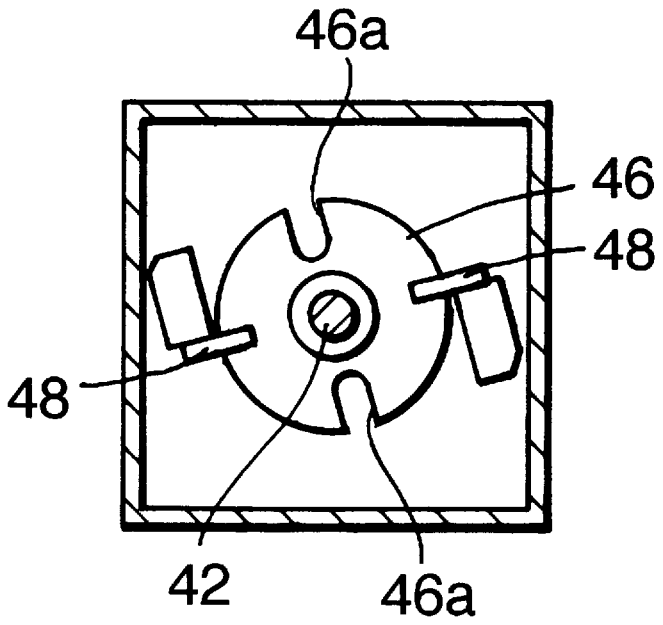
FIG. 4 is a view in section taken along the line 4—4 in FIG. 2.
Figure 5:
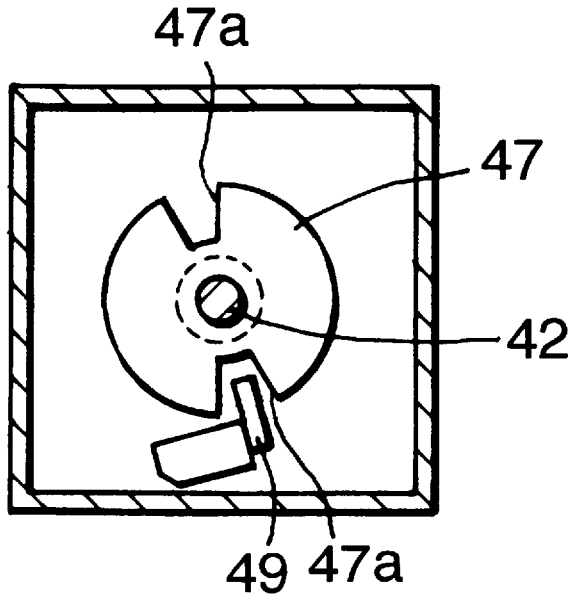
FIG. 5 is a view in section taken along the line 5—5 in FIG. 2.

As seen in FIG. 4, the rotary disk 46 is formed with two slits 46*a* as spaced apart by 180 degrees in corresponding relation with two photoelectric sensors 48 for determining the stop position. As shown in FIG. 5, the rotary disk 47 is formed with two slits 47*a* as spaced apart by 180 degrees. One photoelectric sensor 49 is provided for the slits for detecting the position of the stamp roller.

When the center of one set of stamps 16 is in contact with the impression roller 3 with the web 2 interposed therebetween, one of the two slits 47*a* of the position recognizing rotary disk 47 is in register with the position detecting photoelectric sensor 49 as seen in FIG. 5, and the two slits 46*a* of the stop positioning determining disk 46 are shifted from the stop position determining sensors 48 by 90 degrees as shown in FIG. 4. When the pulse motor 41 rotates through 90 degrees from this state, the two slits 46*a* of the disk 46 register with the respective sensors 48, and this position is the stop position of the pulse motor 41.

The step of adjusting the stamping device 1 and the step of operating the device 1 will be described with reference to FIGS. 6 and 7.

As shown in these drawings, the web 2 has register marks R1, R2, R3 at an interval corresponding to the length of one container. The stamping command sensor 31 and the stamping position recognizing sensor 32 distinguish between the blank area and the register marks R1, R2, R3 which are solid black to detect the presence or absence of the mark. The web can be formed with straw holes with such a sensitivity difference that the holes are readily detectable as the register marks to be distinguished from various print designs.

Figure 6:
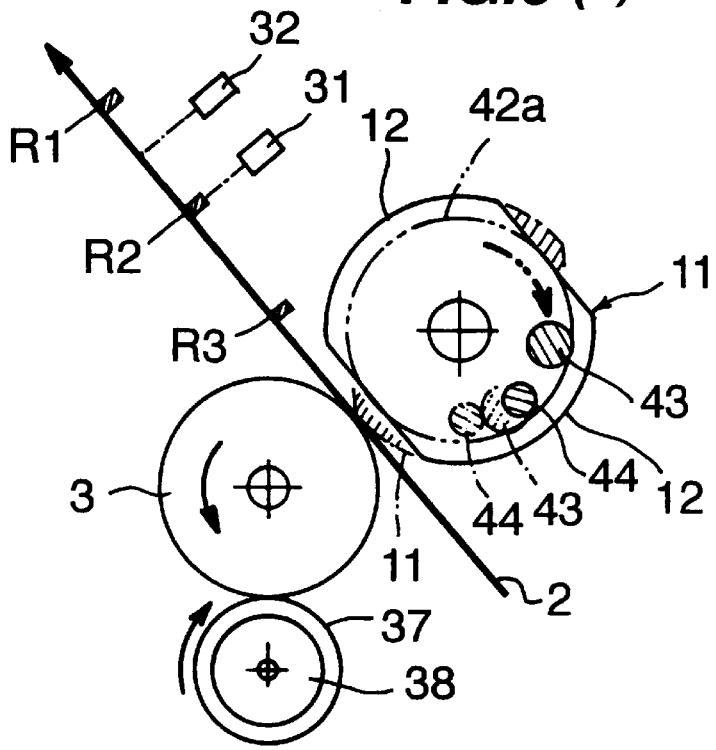
FIGS. 6(*a*) and 6(*b*) are diagrams showing the position of components relative to one another when a stamping operation is to be started.
Figure 6:
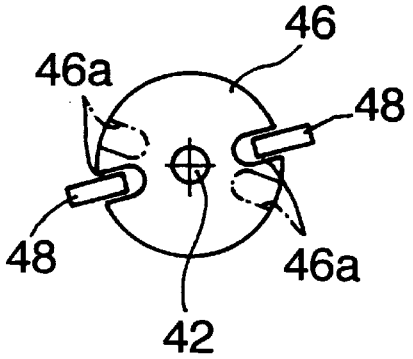
Figure 7:
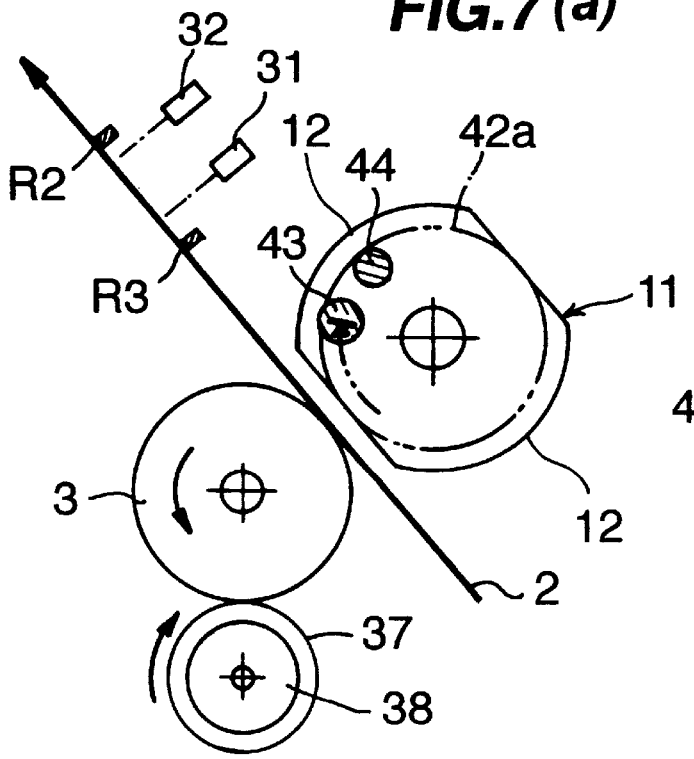
FIGS. 7(*a*) and 7(*b*) are diagrams showing the position of the components relative to one another on completion of the stamping operation.
Figure 7:
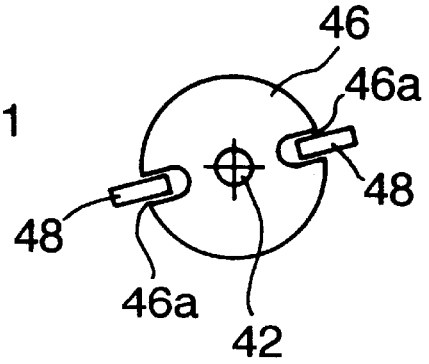

As an adjusting procedure preceding the stamping operation, the two skits 46*a* of the rotary disk 46 are registered with the respective two sensors 48 when the register mark R2 is detected by the stamping command sensor 31 (see FIG. 6(*b*)). This permits the stamp roller 11 to stop at a position corresponding to the stop position of the pulse motor 41, i.e., at a position where the stamps 16 are away from the web 2 (solid-line state shown in FIG. 6(*a*)).

Upon the stamping command sensor 31 detecting the register mark R2 with the start of stamping operation (FIG. 6(*a*)), a stamping command signal is given, whereupon the speed of travel of the web 2 is detected from the signal from the encoder 38. Subsequently, the length of time from the time when the command signal is output until the time when the pulse motor 41 is to be started and the speed of the motor 41 to be rotated are calculated based on the speed of travel of the web 2. The motor 41 is initiated into rotation based on the result of calculation. The rotation of the pulse motor 41 brings the drive pin 43 into contact with the driven pin 44, whereupon the stamp roller 11 starts to rotate. When the O rings 19 contact the web 2 with the rotation of the roller 11 (the state indicated in broken lines in FIG. 6(*a*)), the roller 11 is caused to rotate at the same speed as the web 2 by the friction between the web 2 and the O rings 19, producing an impression in the meantime. The stamp roller 11 comes to a stop upon the O rings 19 leaving the web 2. The pulse motor 41 rotates through 180 degrees and stops upon the two slits 46*a* registering with the respective two stop position determining sensors 48 (see FIG. 7). The stamp roller 11 in the stop position is rotated again by the drive pin 43 of the pulse motor 41 and comes to a halt at the position corresponding to the stop position of the motor 41. When the stamping command sensor 31 detects the next register mark R3 with a further travel of the web 2 from the state shown in FIG. 7, another stamping command signal is given to repeat the same step as above.

Figure 8:
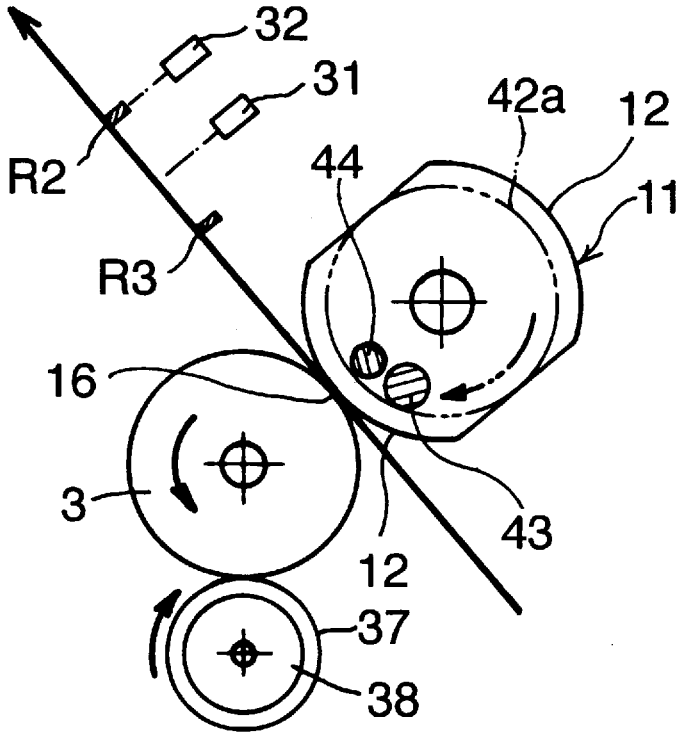
FIGS. 8(*a*) and 8(*b*) are diagrams showing the position of the components relative to one another during the stamping operation.
Figure 8:
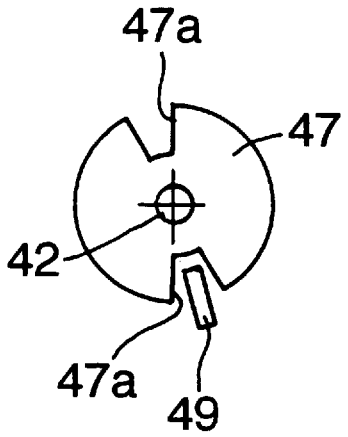

With reference to FIG. 8, a description will be given of an adjusting step for the detection of the stamping position and the step of operating the stamping device 1.

For adjustment prior to the stamping operation, one of the two slits 47*a* in the stamp roller position recognizing disk 47 is registered with the roller position detecting sensor 49, with the center of a stamping space on the web 2 in coincidence with the center of the set of stamps 16, and the stamping position recognizing sensor 32 is registered with the mark R2. When the pulse motor 41 is rotated with the start of stamping operation, one of the two slits 47*a* of the disk 47 registers with the sensor 49 upon the center of the set of stamps 16 coming into contact with the web 2. When the sensor 32 detects the register mark R2 at this time (the state of FIG. 8), this indicates that there is no misregister. For example, it is likely that the speed of the web 2 will suddenly increase with the stamp roller 11 failing to follow the rapid travel of the web 2 after the stamping command signal is given and before the roller stops at the specified position. In such a case, the sensor 32 fails to detect the register mark R2 even if one of the slits 47*a* of the disk 47 is in register with the sensor 49. This is interpreted as indicating misregister, actuating an alarm buzzer and automatically discharging the container with the misregister. The stamping position, if slightly altering, can be adjusted by moving the sensor mount bar 30 upward or downward to similarly move the sensor 31 and alter the time when the stamping command signal is to be output.

The stamping device described is merely an illustrative embodiment, and the invention is not limited to this embodiment. For example, a support member 13 of increased size is usable for supporting at least three stamp rollers thereon, while the support member 13 is made rotatable instead of being pivotally movable by using a stepping motor (pulse motor) or servo motor in place of the rotary actuator 14. The support 13 can be moved pivotally by driving the arm fixed to the pivot by a hydraulic cylinder. Instead of providing two sets of stamps 16 as spaced apart by 180 degrees, it is of course possible to arrange at least three sets of stamps at an interval. In the case where the packaging machine including the present stamping device has a pair of opposed jaws for alternately producing closed containers as disclosed, for example in JP-A-93010/1981, the two sets of stamps 16 spaced apart by 180 degrees can be made to alternately impress two different supervision marks each identifying one of the two jaws used for producing a particular container. Four sets of stamps 16, when arranged at an interval of 90 degrees, can also be adapted to impress two different supervision marks alternately for identifying one of the two jaws used.

What is claimed is:

1. A stamping device comprising two stamp rollers, a support member having the two stamp rollers mounted thereon and arranged on a circumference having a center at a center of pivotal movement, the stamp rollers being spaced apart by a predetermined angle of 45 to 100 degrees about the center of pivotal movement, drive means for pivotally moving the support member so that one of the stamp rollers in a stamping position and the other stamp rollers in a standby position are alternately shiftable to the other position, and drive means for rotating the stamp roller in the stamping position.

2. A stamping device as defined in claim 1, wherein the drive means for rotating the stamp roller comprises a motor having an output shaft in alignment with an axis of the stamp roller in the stamping position, a drive projection provided eccentrically on the motor output shaft, and a driven projection provided on the stamp roller so as to be pushed by the drive projection during revolution.

3. A stamping device as defined in claim 1 or 2 wherein a plurality of stamps are attached to an outer peripheral surface of each of the stamp rollers and spaced apart by a predetermined angle, and the stamp roller in the stamping position is rotated by the drive means through the predetermined angle at a time.

4. A stamping device as defined in claim 2, wherein the stamp roller has a portion which is a circular arc in cross section and which rotates by contacting with the web and a portion which does not contact with the web.

5. A stamping device as defined in claim 4, wherein a plurality of stamps are attached to an outer peripheral surface of each of the stamp rollers and spaced apart by a predetermined angle, and the stamp roller in the stamping position is rotated by the drive means through the predetermined angle at a time.

* * * * *